United States Patent [19]

Goursat et al.

[11] Patent Number: 4,521,244

[45] Date of Patent: Jun. 4, 1985

[54] PROCESS OF PRODUCING METAL POWDERS FROM A MOLTEN METAL MATERIAL

[75] Inventors: Albert-Gilbert Goursat, Voisins-le-Bretonneux; Gilles Vernet, Paris; Jean-Francis Rimbert, Igny; Jean Foulard, Ablon; Thierry Darle, Versailles; Jean Bigot, Crosne, all of France

[73] Assignee: L'Air Liquide, Societe Anonyme pour l'Etude et l'Exploitation des Procedes Georges Claude, Paris, France

[21] Appl. No.: 603,491

[22] Filed: Apr. 24, 1984

[30] Foreign Application Priority Data

May 4, 1984 [FR] France ..... 83 07414

[51] Int. Cl.[3] ..... B22F 9/00

[52] U.S. Cl. ..... 75/0.5 B; 75/0.5 BA; 75/0.5 BB; 75/0.5 BC

[58] Field of Search ..... 75/0.5 B, 0.5 BA, 0.5 BB, 75/0.5 BC, 0.5 R, 251; 106/290

[56] References Cited

U.S. PATENT DOCUMENTS 4,124,377 11/1978 Larson ..... 75/0.5 C 4,309,214 1/1982 Foulard et al. ..... 75/0.5 B

*Primary Examiner*—Wayland Stallard

*Attorney, Agent, or Firm*—Lee C. Robinson, Jr.

[57] ABSTRACT

A cryogenic fluid in the liquid phase is put in contact with a metal material maintained in a closed treating vessel, the cryogenic fluid which contains the solid particles formed is exhausted from the vessel, and the solid particles are separated from the cryogenic fluid and collected. The metal material is heated by induction heating with a high-frequency current and maintained in levitation in the cryogenic liquid. The process is applicable to the production of ultra-fine powders from metals which are only slightly volatile.

21 Claims, 1 Drawing Figure

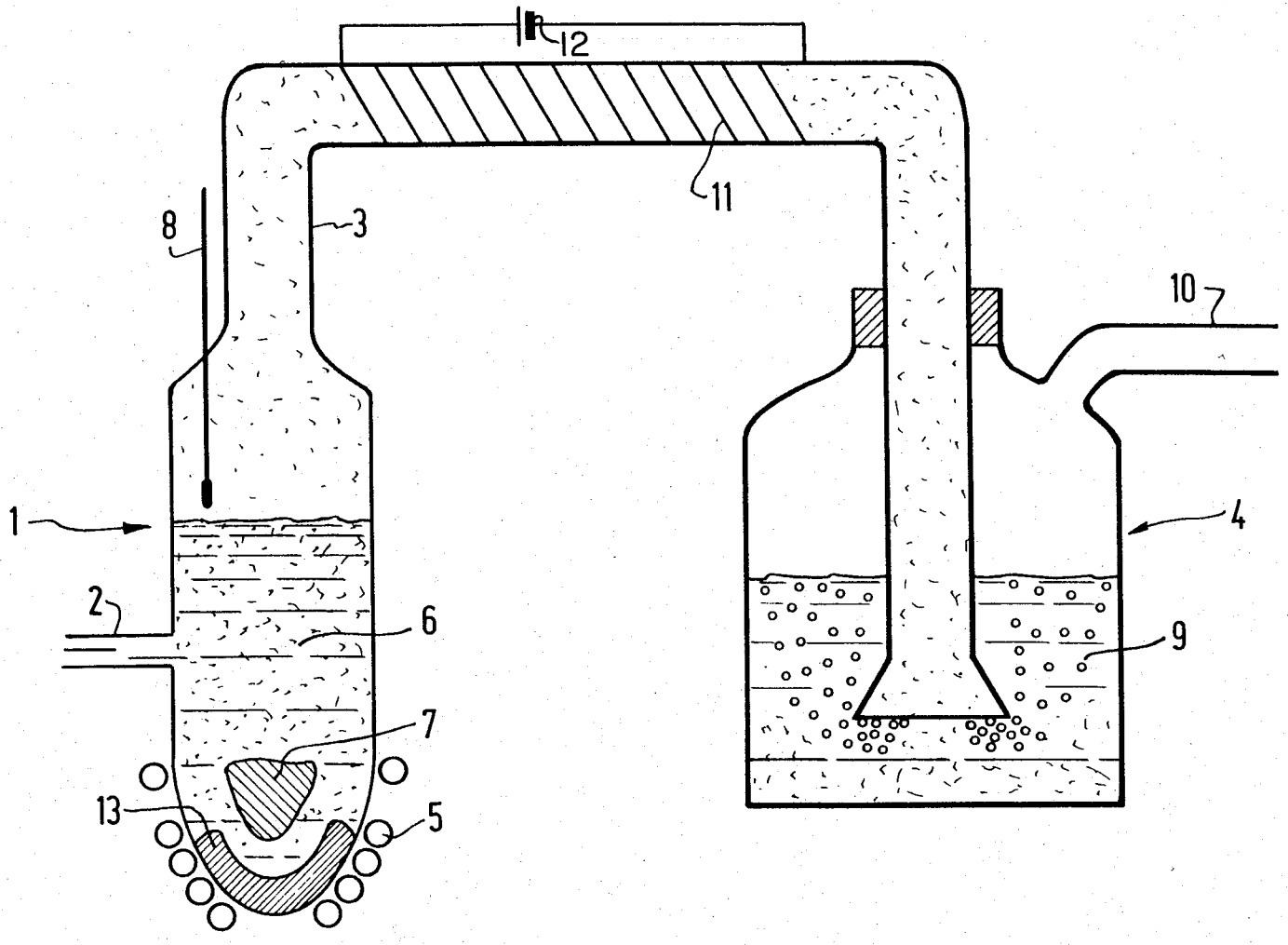
1
2
3
4
5
6
7
8
9
10
11
12
13

PROCESS OF PRODUCING METAL POWDERS FROM A MOLTEN METAL MATERIAL

The present invention relates to a process for producing metal powders, and in particular ultra-fine powders, from a molten metal material.

"Metal Powders" is intended to mean powders formed by solid particles of a single metal, such as iron, zinc, magnesium, etc. or of a metal alloy, for example a magnesium-zinc alloy, or of a metal compound, for example zinc oxide, magnesium nitride, etc.

"Metal material" is intended to mean either a pure metal or an alloy of two or more metals.

Among the processes known at the present time, according to which it is desired to obtain ultra-fine metal powders from a metal bath (pure metal or alloy), or to eliminate selectively one or more metals in the form of solid particles from a mixture of molten metals, there may be mentioned the process disclosed in French Pat. No. 78 26,648 of Sept. 18, 1978 in the name of the Applicant. This process employs the principle of the conversion of the vapour of a molten material into solid particles by the lowering of the temperature of said vapour. It comprises pouring a cryogenic fluid in the liquid phase onto the metal bath, which is brought to such temperature that its vapour pressure is at least 1 mm of Mercury, exhausting from the vessel the cryogenic fluid which contains, in suspension, the solid particles formed, separating the particles from said fluid and collecting them so as to obtain the aforementioned powder. According to this process, the use of a cryogenic fluid in the liquid phase permits a very rapid cooling of the metal vapours coming from the bath and their direct passage from the gaseous state to the solid state.

The process disclosed in French Pat. No. 78 26,648 (corresponding to U.S. Pat. No. 4,309,214) has the advantage of permitting the obtainment from a pure metal or from alloys, of solid particles having a regular shape and a small particle size (100 Å to 2000 Å). However, this process has the drawback of only being of utility for the obtainment of metal powders whose vapour pressure corresponds to moderate temperatures. For example, with volatile metals such as lead, zinc, magnesium, it is sufficient to melt the metal at temperatures lower than 1000° C. On the other hand, with less volatile metals such as iron, nickel, cobalt, melting temperatures higher than 2300° C. must be reached. Now, the materials from which the metal-melting crucibles are usually made do not have a sufficient mechanical resistance to withstand temperatures higher than 2000° C.

An object of the invention is in fact to provide a process which avoids the aforementioned drawbacks and permits the obtainment of powders of elements whose vapour pressure corresponds to very high temperatures.

The process for producing metal powders according to the invention comprises putting into contact with a cryogenic fluid in the liquid phase in a closed treating vessel, a metal material which is heated to such temperature that its vapour pressure is at least 1 mm of Mercury, exhausting from the vessel the cryogenic fluid which contains, in suspension, the solid particles formed, separating said particles from said fluid, and collecting them so as to obtain the aforementioned metal powder, characterized in that said metal material is heated by high-frequency induction current and maintained in levitation in the cryogenic liquid.

As is known, the principle of melting in levitation comprises placing a metal part in an inductor of suitable shape through which high-frequency currents pass. According to the principle of melting in levitation, the interaction between the magnetic field and the currents induced in the metal part enables the latter to float i.e. to be in a state of levitation, with no contact with a material support. Thus, the fact that the metal material is heated according to the invention by melting in levitation enables it to be brought to temperatures higher than 2000° C. with no problem so as to obtain, owing to the contact with the cryogen liquid, solid particles from metals which are volatile only at very high temperatures.

Further, when the metal material is maintained according to the invention in the molten state in the cryogenic liquid, the latter, which is separated from said material by a gaseous layer owing to the phenomenon of calefaction, is heated in the vicinity of the molten metal material; the cold vapours thus formed condense the metal vapours coming from the material and immediately convert them into solid particles which are entrained upwardly by the remaining vapours of the cryogenic liquid. There results a displacement of the metal liquid-metal vapour equilibrium which results in the suction of other metal vapours which are immediately condensed in the form of solid particles and entrained upwardly.

According to the invention, the treating vessel is maintained either at atmospheric pressure or at a pressure higher than atmospheric pressure. Working at a pressure higher than atmospheric pressure enables the metal powder production rate to be increased. Indeed, when a higher working pressure is used, the gaseous layer surrounding and separating the molten metal material from the cryogenic liquid is less thick. Consequently, the cold vapours of the cryogenic liquid cool the metal vapours more rapidly and, as a result, the suction phenomenon described above is more rapid.

Moreover, as the metal is heated in levitation according to the invention, it is subjected to a mixing produced by the circulation current due to the interaction between the magnetic field and the currents induced within said metal. This increases and renews the thermal exchanges with the cryogenic liquid.

According to a feature of the invention, when it is desired to produce powders of a single metal or powders of a metal alloy, the cryogenic fluid used is a fluid which is chemically inert relative to the metal material, such as nitrogen, argon, helium. In order to produce powders of a metal alloy, the starting metal material may be formed by:

either a mixture of metals which have substantially the same vapour pressure (for example an iron-nickel mixture), or a mixture of metals whose composition is such that it compensates for the difference between the vapour pressures of the pure metals constituting the mixture (for example in starting with an iron-manganese mixture having a low concentration of manganese, an iron-manganese powder may be obtained having 20% of manganese owing to the fact that the manganese is much more volatile than the iron).

According to another feature of the invention, when it is desired to produce powders of metal compounds such as oxides, nitrides, hydrides, the cryogenic fluid employed is a chemically active fluid chosen in accordance with the desired compound.

The features and advantages of the invention will be apparent from the following description with reference to the accompanying FIGURE which diagrammatically represents, by way of example, an apparatus for one manner of carrying out the considered process.

The apparatus shown in the accompanying FIGURE comprises a quartz treating vessel 1 which is closed and therefore isolated from the surronding atmosphere and provided with a pipe 2 supplying cryogen liquid and provided in its upper part with an exhaust pipe 3 which communicates with a recovery container 4. A device for melting in levitation, of which only the coils 5 of the inductor are shown, is placed in the vicinity of the lower part of the vessel 3. The inductor employed is an inductor of a known type constituted by a conical winding of a few coils (copper tubes cooled with a flow of water) surmounted by one or two coils which are wound in the opposite direction.

Liquid argon is introduced through the pipe 2 at a sufficient rate of flow to ensure that the bath of liquid argon 6 permanently fills roughly one half of the vessel 1 so that the metal material 7 which is heated in levitation is constantly immersed in said bath 6. The level of the bath of liquid argon 6 is controlled by a level detector 8.

When the metal material 7 reaches a temperature higher than 2000° C., a suspension of metal particles is formed in the bath of argon 6. The argon vapours which are formed entrain these metal particles in the exhaust pipe 3 and conduct them into the recovery container 4.

The container 4 contains an organic liquid 9 which is chemically inert relative to the metal constituting the particles, such as a hydrocarbon, for example hexane, and the pipe 3 is plunged into said liquid 9. The gaseous argon containing the particles bubbles into the hexane; the gaseous argon is exhausted through a pipe 10 connected to the upper part of the container 4 and the metal particles remain in suspension in the hexane which thereafter performs the function of a conditioning liquid.

For the purpose of avoiding a problem of possible freezing of the hexane, a band 11 including heating resistances supplied with current by an electric generator 12, is wound around a part of the pipe 3.

When it is desired to interrupt the production of powders, the induction heating is stopped and this stops the levitation phenomenon. For this reason, in order to ensure that the superheated material 7 does not damage the quartz vessel 1, a crucible 13 of alumina is placed in the bottom of this vessel.

It will be understood that there may be provided several recovery containers containing hexane, in parallel if there is a high rate of flow of gaseous argon which is liable to have an adverse effect on the regularity of the bubbling, or in series if it is desired to eliminate completely the powders from the gaseous argon.

Further, there has been described hereinbefore a manner of recovering powders formed by bubbling in an organic liquid, said organic liquid thereafter performing the function of a reserve of said powders which are contained in suspension. The powders could also be collected by filtering, gravity, etc.

The invention is advantageously applicable to the production of ultra-fine metal powders from slightly volatile metals, these powders being constituted by a single metal, or a metal alloy, or a metal compound. It may also be applicable to the selective elimination of one or more metals in the form of powder from a mixture of molten metals.

What is claimed is:

1. In a process for producing a metal powder, comprising putting a metal material heated to such temperature that the vapour pressure thereof is at least 1 mm of mercury in contact with a cryogenic fluid in the liquid phase in a closed treatment vessel so as to lower the temperature of said vapour and convert said vapour into solid particles, exhausting from said vessel the cryogenic fluid which contains said solid particles in suspension, separating said particles from said fluid, and collecting them so as to obtain said metal powder; the improvement wherein said metal material is induction heated with a high-frequency current and maintained in levitation in said cryogenic liquid.

2. A process according to claim 1, comprising introducing the cryogenic fluid into said vessel and exhausting it from said vessel in a continuous manner.

3. A process according to claim 1, comprising exhausting the cryogenic fluid from said vessel in a gaseous phase.

4. A process according to claim 1, comprising separating the solid particles from the cryogenic fluid and collecting the particles by bubbling in a bubbling liquid.

5. A process according to claim 4, wherein the bubbling liquid is a liquid which is chemically inert relative to the metal constituting said particles.

6. A process according to claim 5, wherein the bubbling liquid is an organic liquid.

7. A process according to claim 6, wherein said organic liquid is hexane.

8. A process according to claim 1, wherein the metal material is substantially pure metal.

9. A process according to claim 1, wherein the metal material is a pure metal.

10. A process according to claim 1, wherein the metal material is an alloy of a plurality of metals.

11. A process according to claim 1, wherein the cryogenic fluid is a fluid which is chemically inert relative to the metal material.

12. A process according to claim 11, wherein said chemically inert fluid is nitrogen.

13. A process according to claim 11, wherein said chemically inert fluid is argon.

14. A process according to claim 11, wherein said chemically inert fluid is helium.

15. A process according to claim 1, wherein the cryogenic fluid is a chemically active fluid.

16. A process according to claim 1, comprising maintaining the treatment vessel at a pressure equal to atmospheric pressure.

17. A process according to claim 1, comprising maintaining the treatment vessel at the pressure higher than atmospheric pressure.

18. A reserve of metal powder having a particle size of about 100 Å to about 2000 Å and being formed of a metal having a melting temperature of higher than 2000° C., said reserve being constituted by a suspension of said powder in an organic liquid.

19. A reserve of metal powder according to claim 18, wherein said liquid is a liquid hydrocarbon.

20. A reserve of metal powder according to claim 19, wherein said hydrocarbon is hexane.

21. A reserve of metal powder according to claim 18, wherein said metal is selected from a group consisting of iron, nickel, cobalt, and alloys thereof.

* * * * *